US005140880A

United States Patent [19]

Littleton

[11] Patent Number: 5,140,880

[45] Date of Patent: Aug. 25, 1992

[54] PUSH-PULL APPARATUS AND METHOD FOR WEB CUTTING AND TRIM STRIP REMOVAL

[75] Inventor: Francis J. Littleton, Alden, N.Y.

[73] Assignee: Littleton Industrial Consultants, Inc., Alden, N.Y.

[21] Appl. No.: 697,200

[22] Filed: May 8, 1991

[51] Int. Cl.[5] ..... B26D 7/18

[52] U.S. Cl. ..... 83/98; 83/24; 83/100; 83/123; 83/346

[58] Field of Search ..... 83/24, 27, 98, 99, 100, 83/402, 123, 168, 127, 164, 346

[56] References Cited

U.S. PATENT DOCUMENTS

| | | | |
|---|---|---|---|
| 3,274,487 | 9/1966 | Ehlscheid | 83/99 |
| 3,476,237 | 8/1976 | Bossons | 83/402 X |
| 3,875,836 | 4/1975 | Hutchinson et al. | 83/100 X |
| 4,276,800 | 7/1981 | Koppa et al. | 83/100 X |
| 4,409,870 | 10/1983 | Rynik et al. | 83/24 X |
| 4,480,516 | 11/1984 | Leroy | 83/98 |
| 4,534,248 | 8/1985 | Anderson | 83/99 X |
| 4,543,865 | 10/1985 | Kranski | 83/164 X |
| 4,896,572 | 1/1990 | Smyth et al. | 83/168 X |
| 5,036,737 | 8/1991 | Glaser | 83/402 X |

*Primary Examiner*—Frank T. Yost
*Assistant Examiner*—Kenneth E. Peterson
*Attorney, Agent, or Firm*—Sommer, Oliverio & Sommer

[57] ABSTRACT

An improved device for cutting a single or multiple-layer continuous web is equipped with a closed-loop, fan-driven air system to "push" air onto the leading edge of the continuous web and "pull" air from about the knife edges to capture the waste material produced by the removal of blank portions. Chambers in the knife roll assembly direct positive air pressure continually to the leading edge for reliably guiding the web into subsequent machinery. Additional chambers direct suction to the waste material at the cutting operation to restrain the waste material within the knife roll assembly for most of the rotation of the knife assembly and to transport waste material to a disposal system including a cowl, which is maintained at a substantially greater suction.

5 Claims, 3 Drawing Sheets

PUSH-PULL APPARATUS AND METHOD FOR WEB CUTTING AND TRIM STRIP REMOVAL

BACKGROUND OF THE INVENTION

This invention relates to an apparatus and method for cutting continuous webs into sheets, and, more particularly, to an improved knife roller assembly for cutting single-or multiple layer paper webs, while reducing web misfeeding and improving the separation of waste material from the cut sheets.

Many methods have been devised to facilitate the cutting of continuous webs. Typically, a rotating knife roll assembly cooperates with a stationary or rotating anvil assembly to periodically cut a sheet of predetermined length from the continuous web. The length of the sheet is established by the web feed rate and the distance between successive knives carried by the knife roll.

For efficient operation, the web must be fed and cut and the cut sheets must be conveyed, as fast as possible. However, higher web feed rates contribute to a greater potential of jamming, especially when the cut sheets must be fed into further apparatus. In particular, after the newly-formed leading edge of the web is cut and the sheet is further transported to subsequent feeding or processing stations, misfeeding of the leading edge can occur. This misfeeding results because the unsupported, rapidly-moving leading edge of the continuous web is deflected by the standing ambient air it passes through. The leading edge also tends to adhere to the knife edge and/or follow the curvature of the knife roll or anvil roll. The results of this misfeeding are an undesirable fold along a portion of the web (or a "dog ear") after the web leaves the knife roll assembly, or simply a jammed web.

Given the curved knife roll and its nearly abutting relation to the anvil roll or surface, the leading edge of the web is difficult to support as it is conveyed from the cutting nip. Air jets or vacuum ducts have been located just downstream of the cutting nip to help guide a trailing portion of the cut sheet as it leaves the cutting nip. In these prior art devices, the air jets or vacuum ducts acted on the trailing edge of the cut sheet to direct the trailing edge away from the knife edge and thereby encourage a clean separation of the cut sheet from the knife edge. Air jets have also been used to lift the trailing edge of the cut sheet for tucking and overlapping operations. Many such devices do not address the problem of feeding the cut sheets into subsequent apparatus downstream of the cutting nip at high speeds.

Also, in many applications, it is necessary not only to simply cut the continuous web to produce individual sheets, but also to trim and remove a portion of the web as scrap or waste. For example, where a border or blank portion occurs between the printed images on the web as a result of the spacing between rotary printing plates, and particularly where stripping pins or the like have marred the blank portion, it is advantageous to trim and remove the excess border or blank portion and sever the individual sheets at a single processing station. This can be done by providing two parallel cutting knives which sever a trim or waste strip between the trailing edge of the newly-cut sheet and the leading edge of the web.

However, the waste material created in this process can be difficult to remove, especially at higher web feed rates and where multiple layer webs are processed. Waste material has been removed by the use of vacuum ducts associated with the knife roll or anvil roll, which draw the waste material into or against the knife roll or anvil roll for transport away from the cutting operation. The vacuum ducts may draw the waste strips into and through the cylinder. Unfortunately, it appears that these devices would clog by accumulating waste strips. Vacuum ducts in the knife roll or anvil roll may hold the waste strip against the knife roll or anvil roll in situ to take it away from the cutting nip between those two rolls. The flow through the ducts is then reversed to push the waste strip away from the roll at a position circumferentially removed from the cutting site. However, a system having a reversible suction capability through the same orifice, depending solely on angular displacement, is quite complicated. Further, the ordinary vacuum ducts of such systems still would be incapable of disposing of a multi-layered waste strip. These ducts are only capable of directing suction to the inside layer of the waste strip, which is directly against the suction duct and substantially seals the duct off. Layers of the waste strip behind the inside layer simply are not exposed to the suction, now sealed by the inside layer of the waste strip, and are not usually successfully carried away from the cutting operation. Those layers of the waste strip which are not controlled can become entangled with the equipment or web and rapidly litter the area around the cutting machine.

The prior art also has employed pins on the knife roll to impale the area to be trimmed as waste material, i.e., a ⅜ inch nominal trim width, and carry it circumferentially away from the cutting nip. Stripper bars and ejector cams are used to remove trim strips from these pins, but may be ineffective because the waste material accumulates on the pins or gets caught in the stripper bar and clogs the machine. Further, the pins must be designed to avoid interference with the rotary knife, and tend to become less effective.

Additionally, jamming is sometimes created by an incomplete cut, especially at the second or downstream knife of a knife roll having two parallel knives. Although the first or upstream knife is generally able to cut the web cleanly due to the tension of the web, the downstream knife does not have the mechanical advantage of the web tension. Equipment operators tend to put the second knife down harder to compensate. The effect is a prematurely blunt second knife.

In sum, much of the apparatus mentioned here is inappropriate for reliable high-speed operation because the unsupported leading edge of a sheet or web tends to stick to a knife or to be diverted by the ambient air and thus misfed, or because it does not reliably dispose of the waste material cut from the web.

SUMMARY OF THE INVENTION

The present invention evolved with the general object of improving the prior art devices, particularly by more reliably cutting a multiple layer web and removing waste material during this cutting operation at higher operational speeds. An important aspect of the invention is the recognition and discovery of problems with prior art devices and their causes, and an analysis of what is necessary to overcome such problems and otherwise provide an improved device.

Accordingly, in the disclosed device and method, an air discharge is directed on the leading edge of the uncut portion of the continuous web just after it leaves the cutting nip. By properly positioning this air discharge, the leading edge of the continuous web can be reliably directed away from the knife roll and into subsequent apparatus. In one embodiment, air holes provided in the rotating knife roll assembly exhaust pressurized air onto the leading edge. This is the "push" aspect of the present invention. Air to supply the air holes comes from a pressurized air chamber within the knife roll assembly which is further supplied by pressurized air through a journal coupling to a stationary air supply.

In another aspect of this invention, the disclosed device and method employ a specially-constructed suction duct located between the pair of outwardly converging knives of a knife roll of the kind which trims and restrains a border or blank section of the continuous web between adjacent sheets. This is considered the "pull" feature of the present invention. The suction duct is configured so that a waste strip can be retained against it without blocking it.

The suction duct includes a specially-designed center piece which retains the edges of the waste strip between and spaced from the inner surfaces of the outwardly converging knives. Suction is drawn between the center piece and each knife. The waste material, which can be multi-layered, is held in place by air being sucked past its edges within each pair of knives and the center piece while the knife roll assembly rotates. As a result, the suction duct is capable of retaining a multiple, sheet waste strip on the rotating knife roll.

A portion of the rotating knife roll assembly, circumferentially spaced from the cutting nip, is substantially enclosed within a suction cowl. When the specially-designed suction duct carries a waste strip to a position inside the cowl, the suction drawn by the cowl strips the waste material from the knife roll by overcoming the suction retaining the waste strip on the roll. It may also be possible to combine the suction developed within the section cowl with the "push" feature of this invention to generate both the "push" and "pull" features of the present invention.

The mouth of the cowl interior conforms to the exterior configuration of the knife roll assembly. The slight separation between the cylindrical surface of the knife roll and the cowl defines an annular cavity extending part way around the knife roll and separating the mouth of the cowl from its throat. The individual cutting knives of a multi-knife roll extend into the annular cavity, and tend to seal the annular cavity and thus reduce suction loss from the cowl.

Thus, only air is inducted into the roll to generate the "pull". The suction drawn by the cowl removes the waste material from the center piece of the knife roll assembly after the knives are fully within the cowl and the waste material is thus harmlessly exhausted.

Thus, single or multiple layers of waste material can be reliably transported away from the cutting operation without jamming the apparatus or otherwise interfering with the cutting operation.

Figure 1:
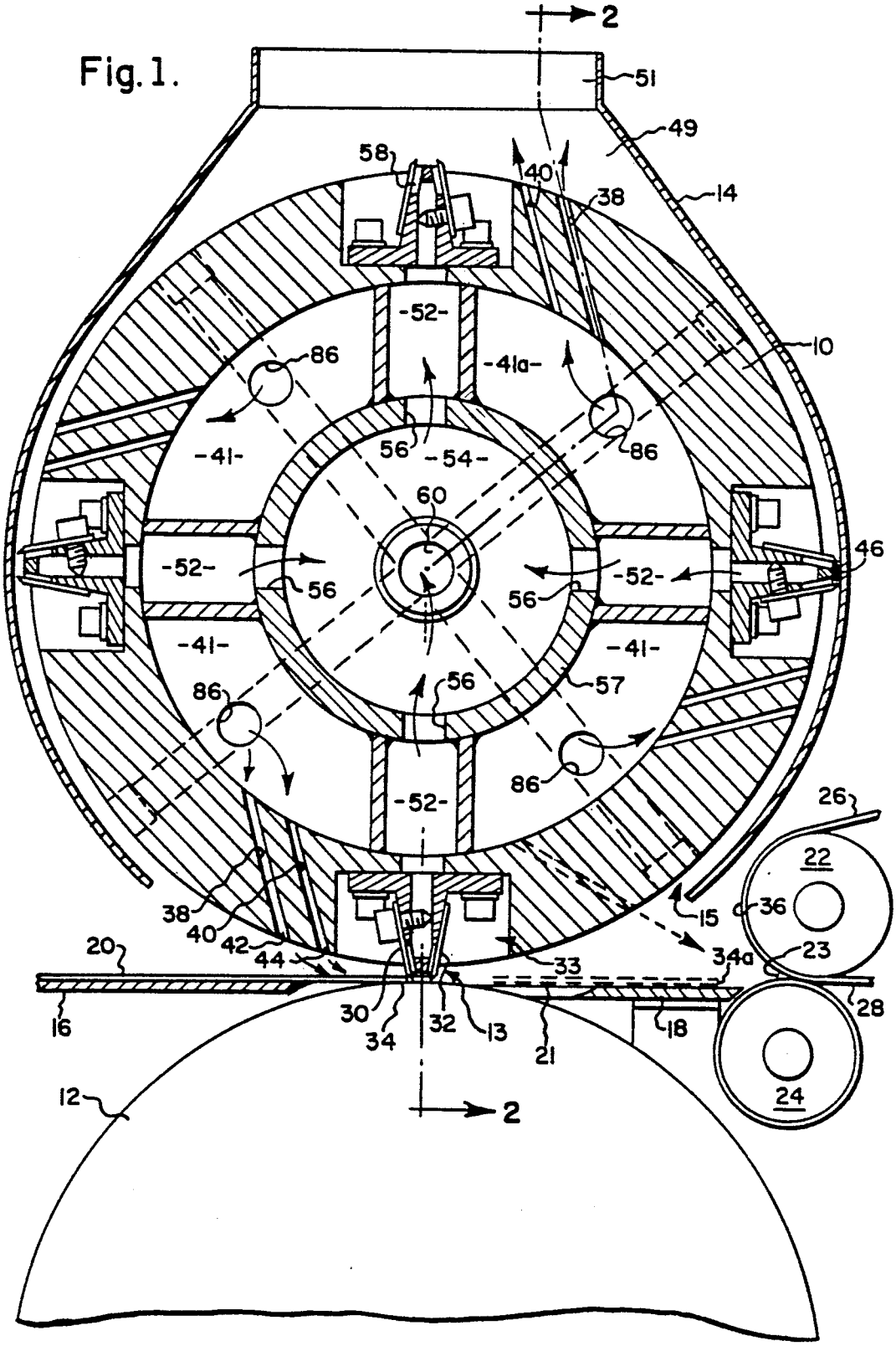
FIG. 1 is a machine direction sectional view of a knife roll and anvil roll assembly in accordance with the present invention. The air duct and the web leading edge (shown in phantom) are out of position, and the cut sheet leaving the cutting nip is foreshortened in the machine direction.

It should be understood that the drawings are not to scale and that certain aspects of the embodiments are illustrated by graphic symbols, schematic representations and fragmentary views. It should also be understood that when referring to physical relationships of components by terms such as "upper", "lower", "upward", "downward", "vertical", "horizontal", "left", "right" or the like, such terms have reference solely to the orientation depicted in the drawings. Actual embodiments or installations thereof may differ.

While much mechanical detail, including other plan and sectional views of the particular embodiments depicted has been omitted, such detail is not necessarily part of the present invention and is considered well within the comprehension of those skilled in the art in the light of the present disclosure. The resulting simplified presentation is believed to be more readable and informative and readily understandable by those skilled in the art. It should also be understood, of course, that the invention is not limited to the particular embodiments illustrated.

DETAILED DESCRIPTION OF THE PREFERRED EMBODIMENTS

Referring to the figures, wherein like reference characters designate like or corresponding parts throughout the views, FIG. 1 illustrates the overall configuration and application of the assembly of a knife roll 10 and an anvil roll assembly 12. The knife roll 10 is provided with a pressurized air discharge capability and a suction intake capability in accordance with the present invention. The knife roll assembly 10 meets the anvil roll assembly 12 at a cutting nip 13. A cowl 14 substantially surrounds and encloses the portion of the knife roll assembly 10 circumferentially away from the nip 13. An input deck plate 16 and an output deck plate 18 are provided to guide a continuous web 20 into the nip 13 and to guide cut sheets 21 into a nip 23 between the tape rollers 22, 24, respectively guiding endless tapes 26, 28. The newly-cut web has a leading edge 34 at the nip 13. The edge 34 advances out of the nip 13 to define an unsupported leading edge **34*a*. The edge 34*a* must be directed between the tapes 26, 28 to further apparatus not relevant here. As was explained previously, the formation of an unsupported leading edge 34*a* is inevitable due to the curvature of the knife roll 10 and the anvil roll 12**.

The leading edge 34 of the web 20 is severed at the nip 13 by the knives 30, 32 at the cutting station 33. The knives 30, 32 are separated by a predetermined gap corresponding to the width of the material to be trimmed or removed. It has been determined that use of the present inventor's patented Dynatrac system to cut the web without the knives physically contacting the hardened anvil roll assembly 12 produces the most beneficial results. ("Dynatrac" is a trademark of Littleton Industrial Consultants.) The description of the structure and function of the combination of the knives 30, 32 and related aspects thereof defining the cutting station 33 applies to all four cutting stations shown about the knife roll 10 in FIG. 1. Although four such cutting stations 33 are shown, more or fewer may be used.

In other devices, as noted above, it is not unusual for the leading edge 34 to be caught on the knife 30 after the knife roll 10 rotates counter-clockwise to carry the knives 30, 32 out of the nip 13. The result would be that the leading edge 34 of the web 20 could be lifted out of its proper plane and misfed, as by striking the tape 26 at a point such as 36, instead of being received between the tapes 26, 28. This misfeeding could fold over the leading edge 34*a* or cause the web 20 to jam in the machine.

Misfeeding of the edge 34*a* is prevented by directing a jet of air from the pressurized air chamber 41 of the knife roll assembly 10, via passages 38, 40 and ports 42, 44 located circumferentially behind and in close proximity to the knife 30. This air jet, while preferably constant, may also be intermittent. When the knife roll assembly 10 rotates sufficiently that the ports 42, 44 have passed to the right of the nip 13, the ports 42, 44 direct air against the leading edge 34 of the web, which is thus blown off the knives 30, 32 and down against the deck plate 18. The leading edge 34*a* thus cleanly enters into the nip 23 between the rollers 22, 24 and between the tapes 26, 28.

Figure 2:
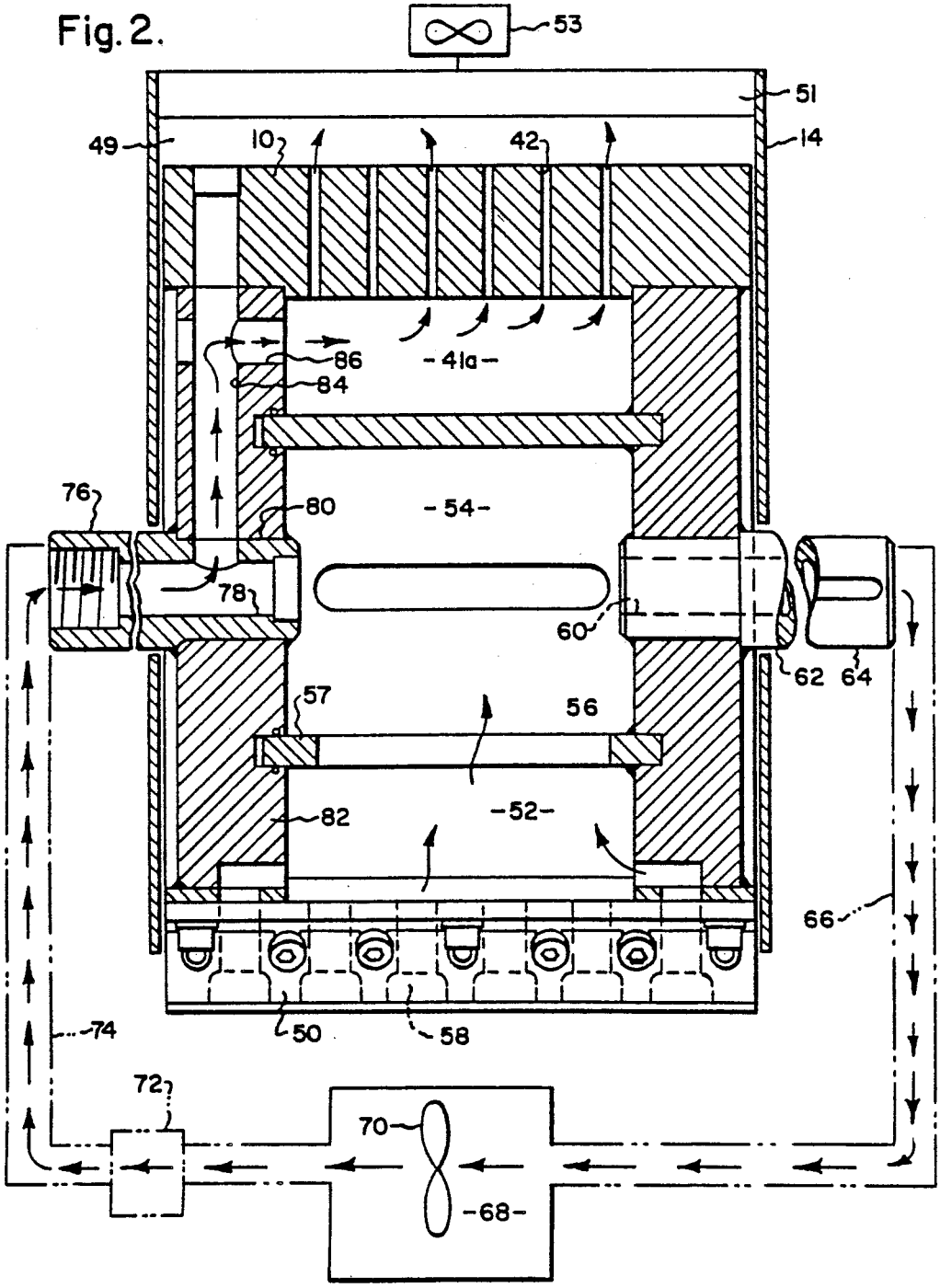
FIG. 2 is a section of the knife roll assembly, taken along the line 2—2 of FIG. 1, showing the internal air passages and an interior surface of a cutting knife. The stationary air supply system is shown schematically.
Figure 3:
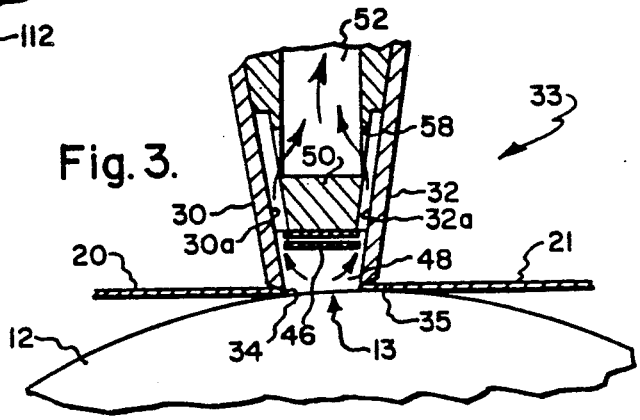
FIG. 3 is an enlarged fragmentary sectional view of the cutting knives and a portion of the knife roll assembly shown in FIG. 1.

A double cut in the web 20 to remove the waste material 46 is also provided. Referring to FIGS. 1–3, the outwardly-converging knives 30, 32 separate a trailing edge 35 of the web 20 (located forward of the knife 32) from the leading edge 34 of the web 20 behind the knife 30 to create a waste strip 46 located between the knives 30, 32. The waste strip 46 may be a multiple layered strip if a multiple layered web is severed by the knives 30, 32.

The knives 30, 32 further define a suction orifice 48 to draw the waste strip 46 severed by the knives 30, 32 against a center piece 50 to which the knives 30, 32 are screwed for support. The center piece 50 has an axially-spaced series of recesses adjacent to each knife 30, 32 to form ports 58, as best seen in FIG. 2. Multiple waste strips 46 can be held against the center piece 50, notwithstanding that the upper or first cut waste strips 46 are not directly exposed to the suction orifice 48, due to the flow of air directed around the bottom layer of the waste strip 46 and the center piece 50 into an interior suction chamber 52, as shown by the arrows in FIG. 3, due to the inwardly-diverging inner surfaces 30*a* and 32*a* of the knives 30 and 32.

As shown in FIG. 3, the waste strip 46 is inducted into the suction orifice 48 when the suction orifice for that particular cutting station 33 is at the six o'clock position, i.e., as shown in FIG. 1. The waste strip 46 is retained in situ as the orifice 48 of the cutting station 33 rotates past the three o'clock position shown in FIG. 1. The suction orifice 48 is thus rotated to a position within an annular cowl discharge chamber 49, defined by the interior surface of the cowl 14 and the exterior surface of the knife roll assembly 10, through the cowl mouth 15. The cowl discharge chamber 49 exerts a significantly stronger suction than the suction chamber 52 due to the operation of a high pressure differential exhaust fan 53 (shown in FIG. 2) placed downstream of the cowl discharge chamber 49. The exhaust fan is preferably capable of developing about 15–20 HP to cleanly remove the waste material 46 from the center piece 50.

By selecting the gap defining the operative radius of the annular cowl discharge chamber 49 in proximity to the nip 13 to closely match the radially projecting height of the knives 30, 32, it can be seen that the cutting stations 33 will tend to close off the suction within the cowl discharge chamber 49 at the cowl mouth 15 from the atmosphere after the knives have cut the paper and are rotated to a position within the cowl 14, i.e., the four o'clock position. The knives function like the seals on a revolving door, which sweep the cylindrical wall of the door housing to substantially prevent air from passing through the door. This tends to seal the cowl discharge chamber 49 and to reduce localized suction that may cause the leading edge 34 of the cut web 20 to lift up and attach to the knives 30, 32 as the knife roll assembly 10 rotates. In effect, the knives 30, 32 serve as rotary seals and eliminate the need for other devices to facilitate this function.

When the cutting station 33 has rotated fully into the cowl discharge chamber 49 past the cowl mouth 15, and further approaches the twelve o'clock position, the orifice 48 is fully exposed to the exhaust orifice or throat 51 of the cowl discharge chamber 49. At this position, the significantly higher suction within the cowl discharge chamber 49 in proximity to the throat 51 overcomes the suction holding the waste strip 46 against the center piece 50 to strip the waste strip 46 from the restraining center piece 50. Due to the several open orifices in communication with the chamber 41, it should be appreciated that the amount of suction available within the orifice 48 will be limited and easily overcome. The waste strip 46 is accordingly drawn into the cowl discharge chamber 49 as the air flow direction shifts to flow from the suction chamber 52, through the orifices 58 and the orifice 48 and through the throat 51 for subsequent transportation away from the cowl 14 to a disposal unit. Thus, each suction port 48 receives a waste strip 46 severed from the web 20 at the six o'clock position and is stripped of this waste strip 46 at the twelve o'clock position by the suction of the cowl discharge chamber 49.

Comparing the main view of FIG. 1 of this embodiment to FIG. 2, taken along the irregular section 2—2, the knife roll assembly 10 can be seen to be divided into four pressurized chambers 41 separated by four suction chambers 52. The suction chambers 52, as noted above, are in constant communication with the suction ports 48 via the orifices 58. The suction chambers 52 are also in constant communication with a chamber 54, which occupies the center of the knife roll assembly 10, through the wall of an inner cylinder 57 via orifices 56. To obtain suction within the chamber 54, air is drawn through an axial passage 60 from a journal 62, a rotary coupling 64, and the conduit 66 to the fan chamber 68. Accordingly, suction is maintained in the chamber 54, and consequently at each suction orifice 48, at all times throughout the rotation of the knife roll assembly 10.

The same closed-loop air pressure system is used to supply pressurized air to the pressurized air chambers 41. The same impeller (also known herein as "air displacement means") 70 in the fan chamber 68 which exhausts air from the suction chambers 54 also provides pressurized air to the chambers 41 of the knife roll assembly 10. The air passing through the impeller 70 is ducted through a damper assembly 72, a conduit 74, a rotary coupling 76, and an axial passage 78 in the journal 80 to the inside of the end plate 82 of the knife roll assembly 10. The air is then ducted through radial bores 84 and axial bores 86 into one of the pressurized air chambers 41, such as 41*a*. The resulting flow of air through the ducts 38 and 40 pushes down the leading edge 34 of the continuous web 20. The resulting suction drawn through the orifices 58 pulls up the waste material 46 formed during the trimming operation. The impeller 70 thus creates both the "push" and the "pull" aspects of the present invention.

It may be possible to use a free-wheeling or speed-controlled impeller 70 driven only by the pressure differential obtained between the cowl discharge chamber 49 and the four pressurized chambers 41. The significantly higher suction existing in the cowl discharge chamber 49 induces air flow through the orifices 38, 40 when one pair of orifices is rotated into the annular cowl discharge chamber 49. As this air is withdrawn from one of the pressurized chambers 41, the entire air column in the end plate 82, joint 80, axial passage 78, coupling 76, conduit 74 and damper assembly 72 is caused to flow. The result is an induced rotation of the impeller 70. A further consequence is that the suction generated by the impeller 70 is transmitted to the suction chambers 52 via the conduit 66, coupling 64, journal 62, passage 60 and chamber 54. Thus, by providing a sufficiently large suction in the cowl discharge chamber 49 and relatively greater air flow through the orifices 38, 40 facing the throat 51 than through the orifices 58, the impeller 70 can be driven without the need for a separate motor. A flywheel can be used to maintain and regulate the speed of the impeller 70.

Figure 4:
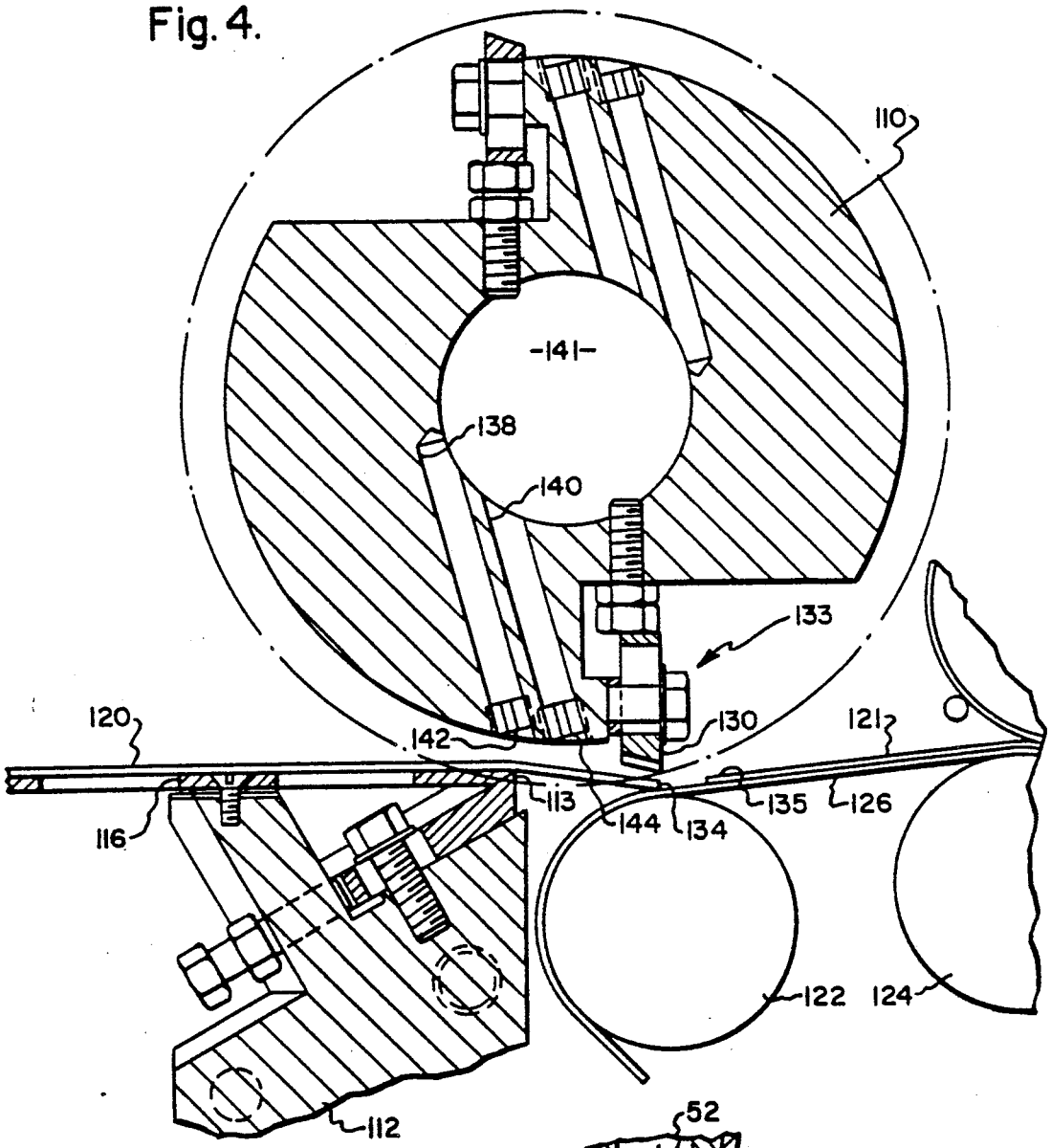
FIG. 4 is a machine direction sectional view of an alternate embodiment of the knife roll assembly employing the air jets in accordance with the present invention.

Turning now to FIG. 4, the overall configuration and application of the knife roll assembly 110 and stationary anvil assembly 112 of an alternative embodiment, provided with only the pressurized air discharge capability in accordance with the present invention, can be seen. Thus, the embodiment of FIG. 4 employs only the "push" feature of the invention. Here, the tape 126 can be set to a faster feed rate than the tapes 26, 18 of FIG. 1 to eliminate the deck plate 18 and provide more efficient transport of the cut sheet 121 to subsequent operations. In the configuration of FIG. 4, the length of the unsupported leading edge 134 of the web is reduced as compared to FIG. 1, but is not eliminated. Note the gap created between the trailing edge 135 of the cut sheet 121 and the leading edge 134 of the web 120 due to the higher speed of the tape 126 relative to the knife roll 110.

The knife roll assembly 110 meets the stationary anvil assembly 112 at an anvil edge 113. An input deck plate 116 is provided to guide a continuous web 120 past the anvil edge 113 and onto the tape rollers 122 and 124 which guide the endless tape 126. The web cut, substantially defined by the leading edge 134, passes the anvil edge 113 and is directed onto the tape 126 for further processing.

The leading edge 134 of the web 120 is severed at the anvil edge 112 by the knife 130 of the knife assembly 133. (As before, the description of the cutting station 133 and associated apparatus applied to all the cutting stations 133 shown in FIG. 4. More or fewer cutting stations 133 may be employed.)

The leading edge 134 is guided by directing a jet of air from a pressurized air chamber 141 of the knife roll assembly 110, via the passages 138, 140 and ports 142, 144 just behind the knife 130. When the knife roll assembly 110 rotates sufficiently that the ports 142, 144 have passed to the right of the anvil edge 113, the ports 142, 144 direct air against the leading edge 134 of the web, which is thus blown off the knife 130 and down against the tape 126. The leading edge 134 accordingly cleanly enters into the nip between the rolls 122, 129 with the tape 126. Here, either an open-loop or closed-loop air pressure system can be used to supply pressurized air to the chamber 141. In much the same manner as earlier discussed, the pressurized air is delivered to the chamber 141 through a rotary coupling and an axial passage to the inside of the knife roll assembly 110. The air is thus available for communication from the pressurized air chamber 141 to the passages 138, 140 and ports 142, 144.

It will be understood that the details, materials and arrangements of parts of specific embodiments have been described and illustrated to explain the nature of the invention. Changes may be made by those skilled in the art without departing from the invention as expressed in the appended claims.

What is claimed is:

1. In a device for sequentially cutting a continuous web of material moving in a plane into individual sheets and for removing a trim portion between a cut sheet and a leading edge of said web, the improvement comprising:

a knife roll mounted for rotation about an axis and having an outer surface moving at a surface speed substantially equal to the speed of said web;

at least one knife means mounted on said knife roll for cutting a sheet and trim portion from said web;

each knife means including a pair of spaced knife blades having outer end portions arranged outwardly beyond said outer surface and having inner end portions arranged inwardly of said outer surface, the spacing between said outer end portions being less than the spacing between said inner end portions such that said blades are outwardly convergent, said blade outer end portions being arranged to cut a sheet and a trim portion from said web when said knife roll is in a particular angular position relative to said axis, a center piece arranged between said knife blades at a position between said inner and outer end portions, and at least one orifice arranged between said center piece and at least one of said knife blades;

negative pressure means communicating with said orifice for causing fluid flow through each orifice from said outer end portions toward said inner end portions;

a cowl partially encircling said knife roll, said cowl having an open mouth facing toward said one particular position; and second means having an exhaust arranged substantially opposite said particular angular position for causing air to flow in the space between said knife roll and cowl from said open mouth toward said exhaust such that, when said knife roll is in said particular angular position, said knife blades will cut a trim portion and a sheet from said web, and said trim portion will be held between said knife blades against said center piece by the flow of fluid through each orifice until said knife means rotates to an angular position at which the flow of fluid through said orifice is reversed due to the influence of said second means.

2. The improvement as set forth in claim 1 wherein a plurality of said orifices are provided between said center piece and said one knife blade.

3. The improvement as set forth in claim 1 wherein a plurality of said orifices are provided between said center piece and both of said knife blades.

4. The improvement as set forth in claim 1, and further comprising: a conduit communicating with said exhaust for conveying severed trim portions from said knife roll.

5. The improvement as set forth in claim 1 wherein said web is multilayered.

* * * * *